US005113920A

United States Patent [19]

Sedeniussen

[11] Patent Number: 5,113,920

[45] Date of Patent: May 19, 1992

[54] WORKBENCH, PARTICULARLY FOR DOORS

[76] Inventor: Svein Sedeniussen, 270 Ehrhardt Rd., Pearl River, N.Y. 10965

[21] Appl. No.: 722,378

[22] Filed: Jun. 25, 1991

Related U.S. Application Data

[63] Continuation of Ser. No. 592,332, Oct. 3, 1990, abandoned.

[51] Int. Cl.[5] ..... B27H 1/00

[52] U.S. Cl. ..... 144/286 R; 144/286 A; 144/287; 182/129; 182/181; 248/439; 269/100; 269/901

[58] Field of Search ..... 182/129, 181; 248/439, 248/440, 123.1; 206/88, 100, 236, 901; 144/286 R, 286 A, 287, 1 R, 2 R

[56] References Cited

U.S. PATENT DOCUMENTS

| | | | |
|---|---|---|---|
| 629,405 | 7/1899 | Taylor | 144/286 R |
| 1,849,673 | 3/1932 | Johnston | 144/286.12 |
| 4,564,181 | 1/1986 | Gansel et al. | 144/286 R |

*Primary Examiner*—W. Donald Bray
*Attorney, Agent, or Firm*—Philip Furgang

[57] ABSTRACT

A hinge connects two sections of a workbench top so that they may be either aligned into a single plane or folded in proximity to each other. Each section of the top hingedly carries a support leg for movement between a collapsed condition in proximity to an underside of the top section and an erected condition extending at right angles therefrom. Side braces hold the legs in their respective erected condition. The legs include a plurality of openings extending therethrough from front to back and at different but aligned levels and each sized to receive a work edge support to support work such as a door or the like in an on-edge disposition and in proximity along either one side or the other side of the workbench. An end support plate is secured to a top section proximate an end and includes a slot to facilitate positioning of the work on end. A tray is hingedly connected along an edge of the top and a work support bar is connectable selectively either along an edge or a side of the top.

40 Claims, 3 Drawing Sheets

FIG. 6
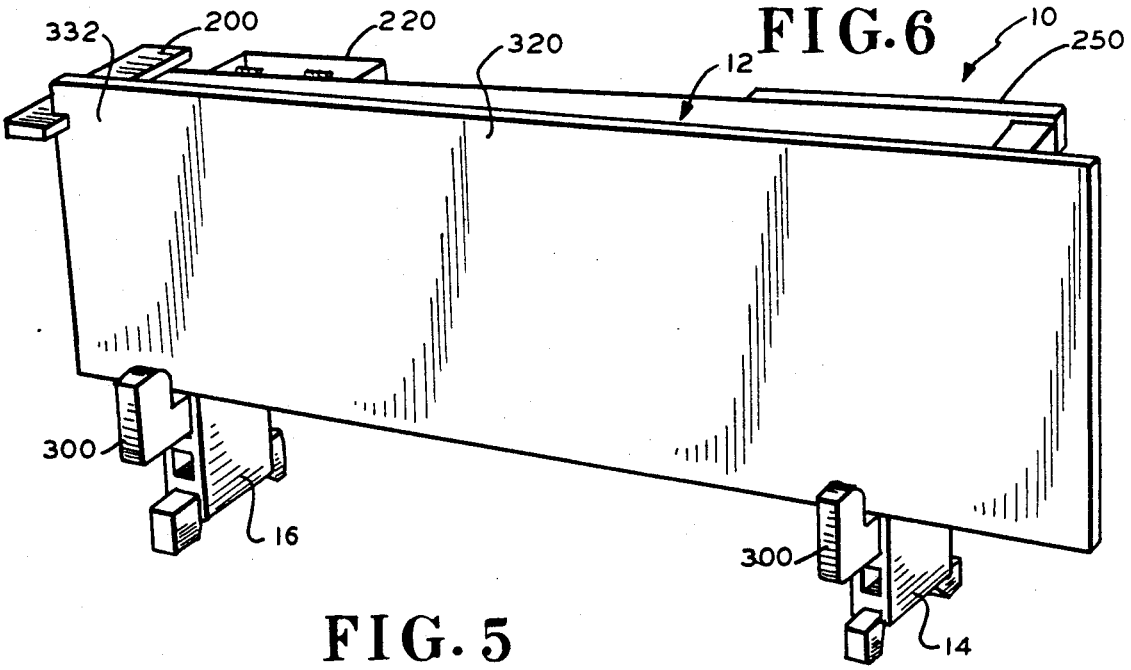
FIG. 5
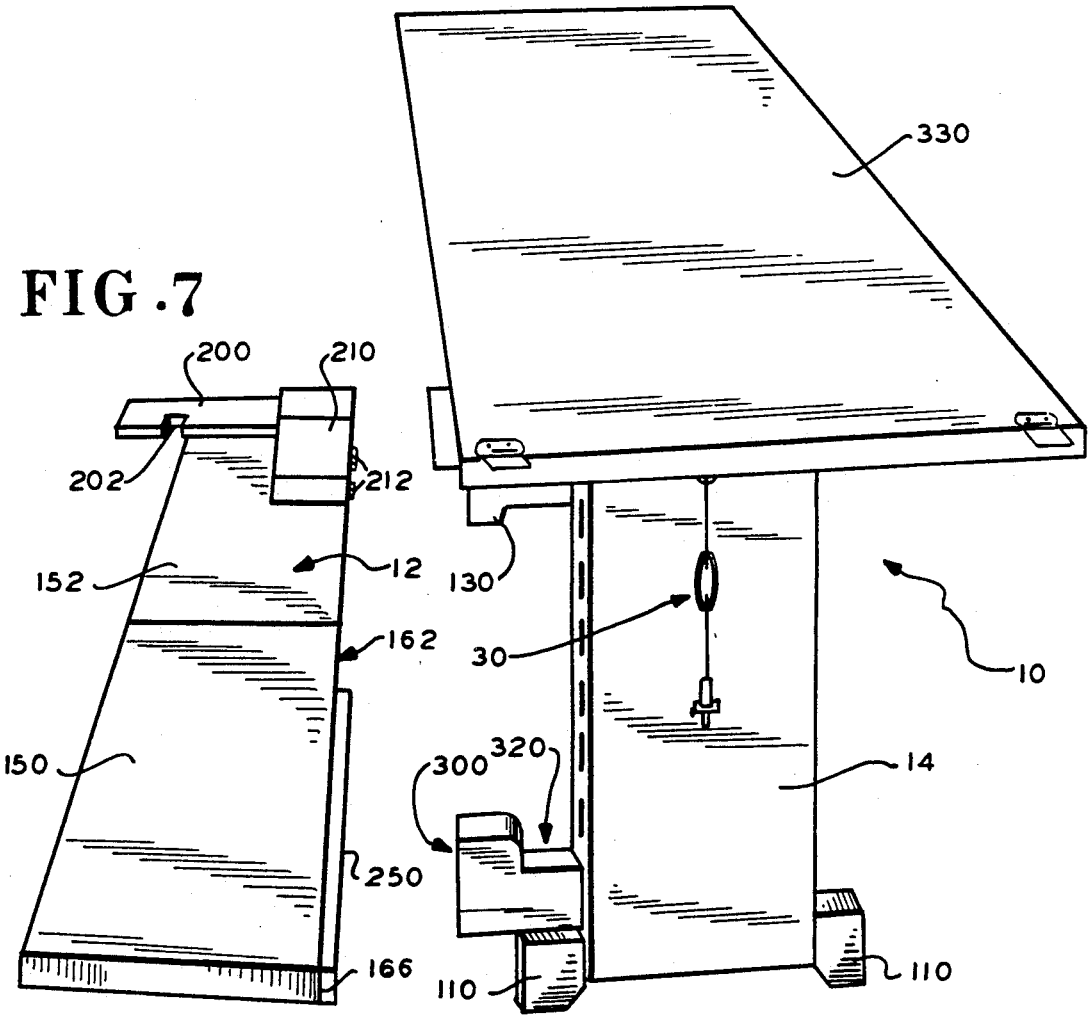
FIG. 7

WORKBENCH, PARTICULARLY FOR DOORS

This is a continuation of copending application(s) Ser. No. 07/592,332 filed on Oct. 3, 1990, now abandoned.

BACKGROUND OF THE INVENTION

1. Field of Application

This invention relates to workbenches; and more particularly to workbenches particularly suited to hold doors, and the like, while work is being performed thereon.

BACKGROUND OF THE INVENTION

2. Description of the Prior Art

Craftsman, tradesman, hobbyists, do-it-yourselfers, and the like, quite often utilize some sort of support to position the item, device, thing, etc., that they are working on; and/or to conveniently locate tools they are using or may need to use, for easy access. Support devices such as shown in U.S. Pat. No. 2,637,358 granted to C. O. Larson on May 5, 1953 for *Saw Horse With A Shiftable Tool Tray;* and in U.S. Pat. No. 4,877,069 granted to S. C. Plumley on Oct. 31, 1989 for *Cutting Table* are but two examples of such support devices. These devices, however, while quite specific to the work applications set forth in the aforementioned patents are quite unsuitable for use with items such as doors and the like.

Other work support devices are shown, by way of example, in U.S. Pat. No. 4,239,195 granted to J. P. Oltman, et al on Dec. 16, 1980 for *Workbench,* and in U.S. Pat. No. 4,375,827 granted to R. Ignjatic on Mar. 8, 1983 for *Workbench Table Too Clamping Device.* However, such support devices are also not suitable for supporting items such as doors or the like while work is being performed thereon since there is no convenient way to support the item to be worked on, an-end, as may need to be done for a door or the like. In addition, while the workbench of U.S. Pat. No. 4,239,195 is described as having collapsible legs it still comprises a relatively long and difficult device to move and transport because only the legs collapse.

U.S. Pat. No. 1,284,170 granted on Nov. 5, 1918 to H. B. Ballantyne for *Work Bench;* U.S. Pat. No. 629,405 granted on Jul. 25, 1899 to V. E. Taylor for *Work Bench;* and U.S. Pat. No. 1,849,673 granted on Mar. 15, 1932 to W. H. Johnston for *Carpenter's Bench,* all show work supports intended to support a door while it is being worked upon. However, the support shown and described in the U.S. Pat. No. 1,284,170 patent may be unacceptably limited in possible uses since it supports the work while in an on-edge disposition from only a single position, and because if it must be relocated it must be moved as assembled thus requiring a relatively large amount of space and probably more than one person to effect the move because of the assembled size, or it must be disassembled and reassembled thus requiring an unacceptable, time consuming and possibly expensive amount of labor. The support device shown and described in U.S. Pat. No. 1,849,673, on the other hand, provides for supporting the work on its edge at selected multiple positions but may be unacceptable because the mechanism for doing so is relatively complex and costly and only supports the work on one side of the workbench and so it will possibly create difficulty for a left-handed person when the workbench is set up for a right-handed person or for a right-handed person if the workbench is set up for a left- handed person. In addition, while the bench of this patent is shown and described as having its legs foldable in and under the table portion the table portion remains at its full length even when the legs are folded in and thus the collapsed device presents a relatively long package which may not be easily disposed in a transport vehicle, such as the trunk of a car, or in an elevator if needed at a building level other than the street level. The support device shown and described in U.S. Pat. No. 629,405 also shows a bench where the work can be selectively disposed at a plurality of possible positions while on-end, however, here also the mechanism for supporting the work in an on-end disposition is and can only be disposed on one side of the bench and thus can be set up for either right-hand or left-hand working but not either especially since a tool box is disposed along the entire length of the bench along the back edge thereof. The bench is not collapsible and because of the tool box cannot be collapsed and the disposition of the tool box may render this type of bench unusable or unacceptable for use if the work is to be laid flat on the support since the work may be disposed at a level which renders work thereon difficult if not impossible.

SUMMARY OF THE INVENTION

It is therefore an object of this invention to provide a new and novel work support.

It is another object of this invention to provide a new and novel workbench particularly adapted for supporting a door, or the like, to have work performed thereon.

It is yet another object of this invention to provide a new and novel workbench particularly adapted to support a door, or the like, in either a planar disposition or an on-edge disposition.

It is yet still another object of this invention to provide a new and novel workbench particularly adapted to support a door, or the like, in an on-edge disposition along either one long side or the other long side of the workbench.

It is a further object of this invention to provide a new and novel workbench which is selectively collapsible from an erected disposition into a relatively compact package.

It is still a further object of this invention to provide a new and novel workbench which includes a longitudinally extending work surface and legs extending therefrom to support the work surface when in an erected disposition and for which the legs are selectively collapsible and the work surface is foldable proximate its center to selectively collapse the workbench from an erected disposition into a relatively compact package.

Other objects, features, and advantages of the invention in its details of construction and arrangement of parts will be seen from the above and from the following description of the preferred embodiments when considered with the drawing and from the appended claims.

BRIEF DESCRIPTION OF THE DRAWING

In the drawing:

FIG. 5 is an isometric drawing of the workbench of FIGS. 1 and 2 looking from an end thereof and with a door laying in a planar disposition on a top surface thereof;

FIG. 6 is an isometric drawing of the workbench of FIGS. 1 and 2 with a door disposed in an on-end disposition along one side thereof;

FIG. 7 is an isometric drawing of the top of the workbench of FIGS. 1 and 2 showing same with a door end bar or support disposed in a stored disposition and with a tray disposed in a folded over position.

DESCRIPTION OF THE PREFERRED EMBODIMENTS

Figure 1:
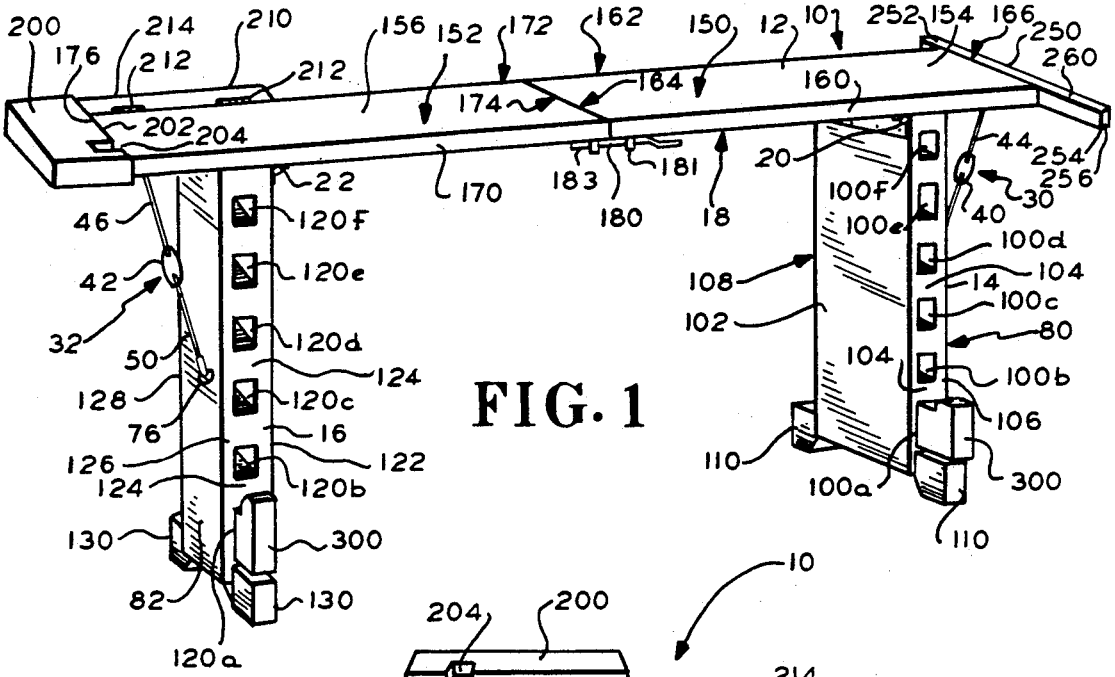
FIG. 1 is an isometric drawing of a workbench incorporating the instant invention.
Figure 2:
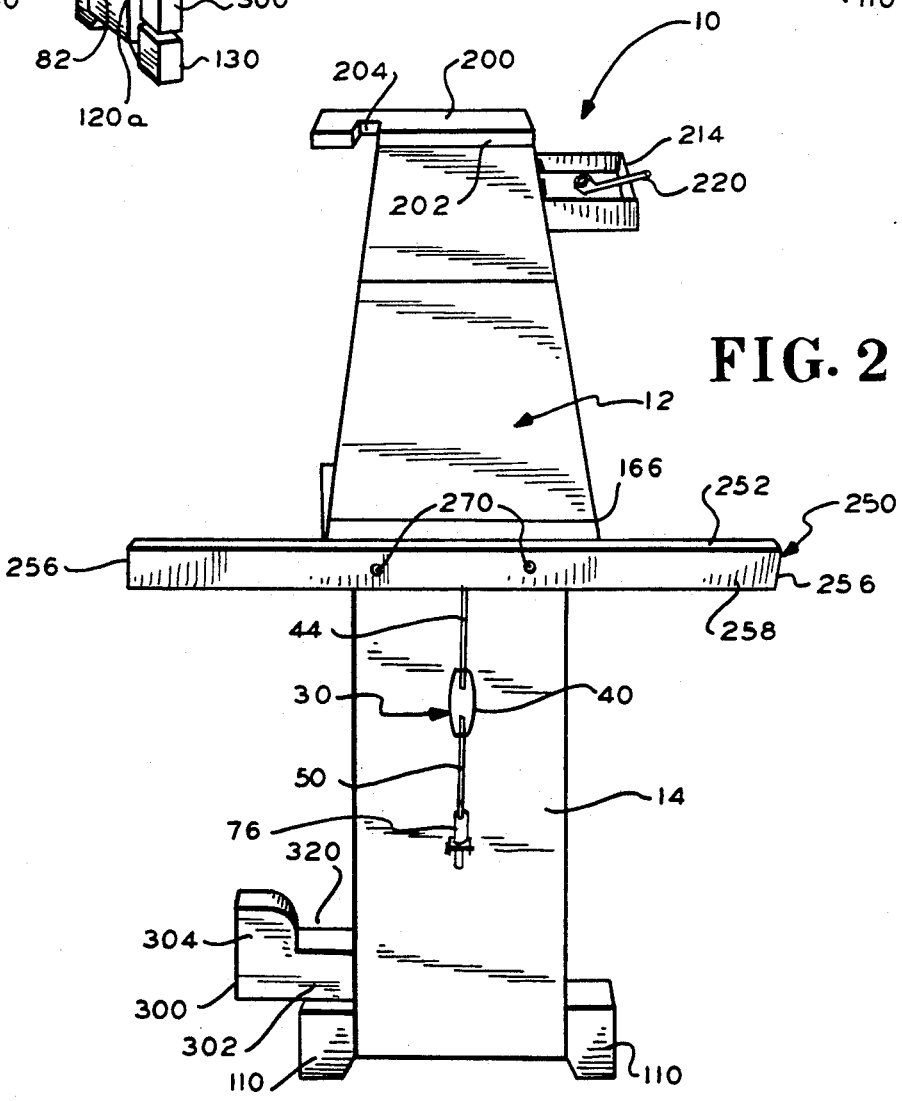
FIG. 2 is an isometric drawing of the workbench of FIG. 1 looking from an end thereof.

With reference to FIGS. 1 and 2 there is generally shown at 10 a work support in the form of a workbench having a top or work support surface 12 disposed in a substantially horizontal planar disposition and having a pair of support legs 14, 16 which in the FIGS. 1 and 2 erected disposition of workbench 10 extend down from an underside or lower surface 18 (FIG. 1) of top 12 at substantially right angles therefrom. A hinge 20 connects leg 14 to underside 18 of top 12 and a hinge 22 connects leg 16 to underside 18 of top 12. Hinges 20 and 22 connect legs 14, 16 respectively to permit legs 14, 16 to pivot towards and in proximity to underside 18 of to 12 as will be described hereinafter and to assume the positions shown for legs 14, 16 in FIGS. 1 and 2.

A first side brace 30 (FIGS. 1-3) serves to selectively connect support leg 14 (FIGS. 1 and 2) to underside 18 of top 12 while a second side brace 32 (FIG. 1) serves to selectively connect support leg 16 to underside 18 of top 12. Side braces 30, 32 each include a centrally disposed turnbuckle 40, 42 respectively. A first rod 44, 46 respectfully, is threadably received in and extends from one end of each turnbuckle 40, 42 respectively; while a second rod 48 (FIG. 2) 50 (FIG. 1) respectively is thready received in and extends from the other ends of each turnbuckle 40, 42 respectively. The threaded connections between turnbuckles 40, 42 and rods 44, 46, 48 and 50 is such that rotation of turnbuckles 40, 42 in one direction (arrows A or B, FIG. 3) about an axis extending through turnbuckles 40, 42 and rods 44, 46, 48, 50, will draw rods 46, 48 into turnbuckle 40 (in the direction of arrows X FIG. 3) and rods 46, 50 into turnbuckle 42 and rotation of turnbuckles 40, 42 in the opposite direction (arrows A or B FIG. 3) will extend rods 46, 48 out from turnbuckle 40 (in the direction of arrows Z FIG. 3) and rods 46, 50 out from turnbuckle 42.

Figure 3:
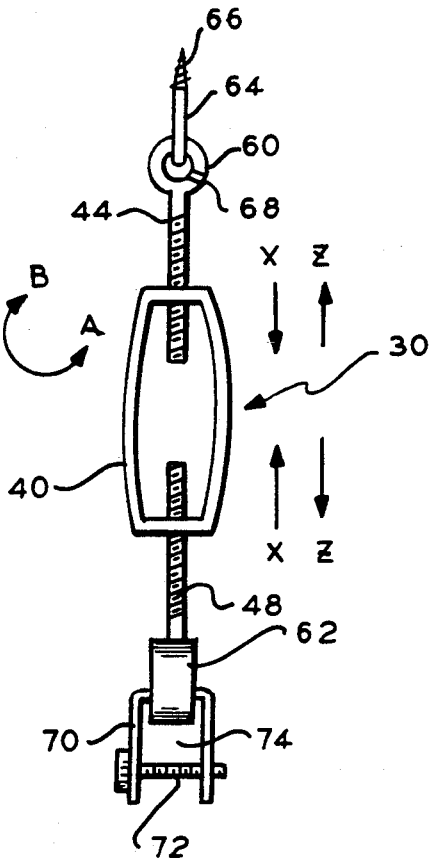
FIG. 3 is a schematic illustration of a side brace utilized for the workbench of FIGS. 1 and 2.

Rods 44, 46, 48 and 50 each terminate at their respective ends opposite to the ends that are thready received in turnbuckles 40, 42 in an eye such as eye 60 (FIG. 3) of rod 44 and eye 62 of rod 48. An eye 64 which receives or is received in eye 60 carries a threaded projection 66 which is threaded into underside 18 of top 12 to locate side brace 30 and side brace 32 for dispositions as shown in FIGS. 1 and 2. Either eye 60 or eye 64 is formed with an opening, such as opening 68 shown for eye 60 to facilitate mating of eyes 60 and 64. A split hasp 70 of substantially "U" shaped configuration is carried by each eye 62 of rods 48 and 50 (FIG. 1). A threaded member 72 is thready received through the spaced legs of hasp 70 as shown in FIG. 3 to span the space therebetween. A space 74 within each split hasp 70 is sized to receive an eye 76 (FIGS. 1 and 2) each of which carry threaded projections (not shown) similar to projection 66 of eye 64 (FIG. 3) to facilitate attachment of eyes 76 toes 80, 82 (FIG. 1) of support legs 14, 16 respectively.

Figure 4:
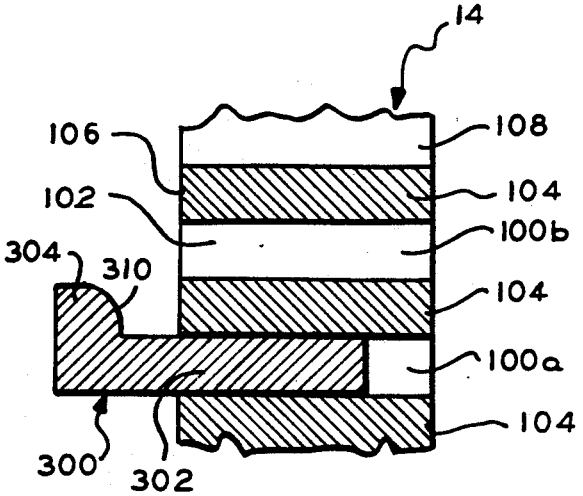
FIG. 4 is an elevational sectional view of a portion of one of the legs of the workbench of FIGS. 1 and 2 showing a door edge support disposed therein.

A number of openings 100*a* (FIGS. 1 and 4), 100*b*, 100*c* (FIG. 1) 100*d*, 100*e* and 100*f* extend through leg 14 between outer surface 80 thereof and an inner surface 102. Spacers 104 (FIGS. 1 and 4) are disposed between surfaces 80 and 104 of leg 14 and openings 100 thereof to define openings 100 and extend between a first side edge 106 of leg 14 and a second side edge 108 thereof. A pair of feet 110 are attached to leg 14 proximate the bottom thereof. A similar number of openings 120*a* (FIG. 1), 120*b*, 120*c*, 120*d*, 120*e* and 120*f* extend through support leg 16 between outer surface 82 thereof and an inner surface 122. Spacers 124 are disposed between surfaces 82 and 124 of leg 16 and openings 120 thereof to define openings 120 and extend between a first side edge 126 of leg 16 and a second side edge 128 thereof. A pair of feet 130 are attached to leg 16 proximate the bottom thereof. Openings 120 *a-f* and spacers 124 are sized and disposed to match openings 100 *a-f* and spacers 104 respectively; and all of same are utilized as will be hereinafter explained.

Top 12 of workbench 10 is divided into two sections 150, 152 (FIGS. 1 and 2) each including an upper surface 154, 156 respectively as well as underside 18. Section 150 includes a first long side 160, a second long side 162, a center edge 164 and an end edge 166; while section 152 includes a first long side 170, a second long side 172, a center edge 174 and an end edge 176. A SOSS-type hinge 180 is disposed between center edges 164, 174 and hingedly connects them together. Workbench 10 may be constructed with all its constituent ports fabricated from wood, metal or other suitable materials or with some parts fabricated from one material and other parts fabricated from other materials. When top sections 150, 152 are fabricated from metal SOSS-type hinge 180 is disposed where center edges 164, 174 meet proximate underside 18; while if top sections 150, 152 are fabricated from wood SOSS-type hinge 180 is disposed between center edges 164, 174 between upper surfaces 154, 156 and underside 18. The hinged connection effected by the conventional SOSS-type hinge 180 is such that center edges 164, 174 will butt against each other when workbench 10 is in its erected disposition as shown in FIGS. 1 and 2 and such that workbench 10 may be collapsed into a compact package as will be hereinafter described. Along opposed marginal edges 160 are carriage bolts 180 slidable through hasps 181 to lock the table in position. (Only one is visible in FIGS. 1 and 8.)

An end plate 200 (FIGS. 1 and 2) may be removably attached as by wing nuts (not shown) disposed proximate end edge 176 of portion 152 of top 12 and provides a stop surface 202 against which an article to be worked on may be disposed when utilizing workbench 10. A slot 204 is formed in plate 200 extending in from surface 202 thereof a predetermined distance. The width of slot 204 is selected to receive the thickness of a door or similar article as will be hereinafter described.

A tray 210 of selected length, width and depth is connected along side 172 of portion 152 of top 12 proximate end plate 200 but not in an overlapping relationship therewith. Tray 210 is connected to side 172 by a hinge 212 or a set of hinges 212 that permit tray 210 is be selectively disposed in the disposition shown therefore in FIGS. 1 and 2 or to be rotated up about hinge(s) 212 so that a top surface 214 of tray 210 can rest upon top surface 154 of portion 152. Tray 210 is sized to receive tools, such as tool 220 (FIG. 2) parts, fasteners, etc., that might be useful when utilizing workbench 10.

An end support bar 250 is provided for use with workbench 10. Bar 250 includes an upper edge 252, a lower edge 254, a pair of oppositely disposed ends 256, a front surface 258 and a rear surface 260. When workbench 10 is to be utilized to support a door, or like item, to be disposed upon surfaces 150, 152 of top 12 then, if that item is relatively wide in relationship to the width of top 12, bar 250 is secured by threaded number 270 (FIG. 2) with its rear surface 260 disposed against end edge 166 of top 12 and so that top 12 is substantially centered between ends 256 of bar 250. When bar 250 is not required for use, as will be hereinafter described, it is detached from edge 166 by removing threaded members 270. Bar 250 is stored by being disposed with its rear surface 260 disposed against long side 162 of top 12 proximate edge 166 thereof and secured in place with fasteners 270 as shown in FIG. 5.

A pair of substantially "L" shaped edge work supports 300 (FIGS. 1 and 2) are also provided for use with workbench 10. Each support 300 includes a longitudinally extending leg 302 (FIGS. 2 and 4) and an arm 304 extending upwardly therefrom at an end thereof. The width and height of leg 302 is selected so that leg 302 may be selectively disposed in any one of openings 100 *a–f* and 120 *a–f*, but so that leg 302 when so disposed will remain in its selected opening without sliding out; unless it is withdrawn therefrom. Arm 304 is sized to form a stop and when disposed with leg 302 in an opening 100, 120 to have an inner surface 310 of arm 304 spaced from the respective side edges 106, 108, 126, 128 of support legs 14, 16 respectively to form a slot 320 of a size and configuration to receive an edge of a door, or the like, when disposed on- end, to facilitate work on the door as will be hereinafter described.

When erected for use workbench 10 appears as shown in FIGS. 1 and 2 with sections 150, 152 of top 12 aligned so that surfaces 154, 156 are in a common and substantially horizontal plane. Legs 14 and 16 extend down from and at right angles to undersurface 18 and side braces 30, 32 are adjusted to maintain that disposition of legs 14, 16. Tray 210 is connected by its hinges 212 along a side edge of top 12 depending upon whether it is to be set up for right-handed or left-handed use. End support bar 250 is secured in place along end edge 166 of top 12.

A door, or similar article, to be worked on, such as door 330 (FIG. 5), can be placed in a substantially planar disposition on top 12 of workbench 10. The necessary work, such as attachment of hinges, placement of knobs and locks or the like can be performed with door 330 is an appropriate disposition suitable for such work. When it is desired to work on an edge of door 330 or to work on door 330 in an on-edge disposition legs 302 of work supports 300 are placed in aligned openings 100 *a–f* and 120 *a–f* (such openings 100*b*, 120*b*) with arms 304 of supports 300 spaced from either first side edges 106 or second edges 108 of legs 14, 16 to form slots 320 of a size to receive the thickness of door 330. End support bar 250 is removed from end edge 166 and stored along side edge 162 as hereinabove described. Door 330 is then placed on-end in slots 320 and upon upper surfaces of legs 302. An upper corner 332 (FIG. 6) of door 330 is then disposed in slot 204 of end plate 200 and door 330 will be disposed, as shown in FIG. 6, in position to have work performed thereon. Depending upon which sides of legs 14, 16 edge supports 300 are inserted from workbench 10 may be set up for either right-hand use or left-hand use.

The end plate 200 may be removed from one side and secured to the other side of the bench so as to accommodate those who are left handed. As an alternate embodiment, there may be provided two end plates (only one is shown) at opposed ends of the bench to accommodate twin doors. In such a construction, two supports 300 are inserted in each opposed openings (e.g., 100*a* and 120*a)* to support a door on opposed sides of the bench.

When workbench 10 is not needed, or if workbench 10 is needed at a different location, it may be collapsed into a relatively compact package and moved. To do so end support bar 250 will need to be stored in its position along side edge 162 of top 12 as shown in FIG. 7. Tray 210 is rotated about hinges 212 from its use disposition of FIG. 2 to a stored position as shown in FIG. 7.

Side braces 30, 32 are then disconnected from eyes 76 by removing threaded members 72 from split hasps 70 and separating split hasps 70 and their respective eyes 76. Thereafter, threaded members 72 are replaced to minimize possible loss thereof. Side braces 30, 32 may thereafter be shortened by appropriate manipulation of turnbuckles 40, 42 or they may remain as previously adjusted.

Figure 8:
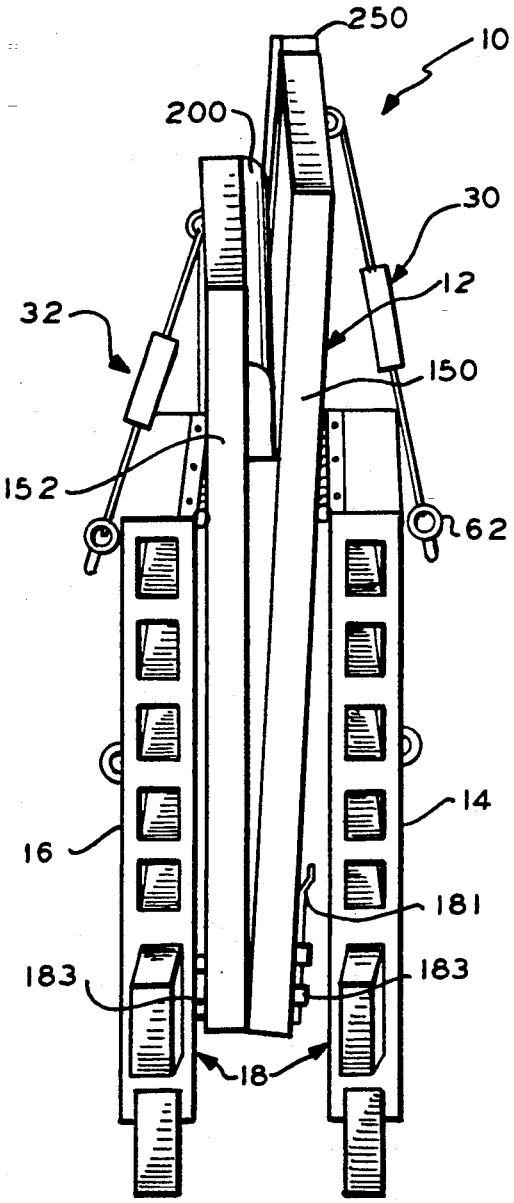
FIG. 8 is an isometric drawing of the workbench of FIGS. 1 and 2 collapse into a disposition for storage and/or transport.

Legs 14, 16 are pivoted about their respective hinges 20, 22, after side braces 30, 32 have been disconnected, so that they are disposed as close to underside 18 of top 12 as possible and top 12 is folded about SOSS hinge 180 so that workbench 10 is disposed in a collapsed condition as shown in FIG. 8. If desired suitable straps may be disposed about collapsed workbench 10 to keep same in its collapsed disposition, and a handle may be secured to leg 14 or 16 on the outer surface thereof to facilitate carrying of collapsed workbench 10. When collapsed, workbench 10 forms a relatively compact package which can be placed on a cart or in a trunk of an automobile for transport; or placed in an elevator for movement to another floor of a building. Work bench 10 can be re-erected: by rotating sections 150, 152 of top 12 about SOSS hinge 180 to place sections 150, 152 in aligned and planar dispositions; by rotating legs 14, 16 about their hinges 20, 22 so that legs 14, 16 are disposed at right angles to underside 18 of top 12; and by re-connecting side braces 30, 32 to eyes 76.

From the above description it will thus be seen that there has been provided a new and novel workbench which is collapsible from an erected condition into a relatively compact collapsed condition and which is particularly constructed to facilitate work on doors, or the like, in both a planar or on-edge disposition of the work and such that the work can be disposed for either right-hand or left-hand access.

It is understood that although I have shown the preferred forms of my invention that various modifications may be made in the details thereof without departing from the spirit as comprehended by the following claims.

What is claimed is:

1. A workbench; comprising:

(a) workbench top means including a first top section and a second top section each such top section including an upper surface, a lower surface, a center edge, an end edge spaced from said center edge and a pair of oppositely disposed side edges which are also spaced from each other;

(b) top hinge means connecting said first top section and said second top section along said respective center edges thereof such that in a first disposition of said top hinge means said first top section and said second top section are disposed with their respective center edges in abutting relationship and with their respective upper surfaces in a common plane; and so that in a second disposition of said top hinge means said lower surfaces of said respective first top section and said second top section are disposed in proximity one to the other;

(c) first leg means hingedly secured to said first top section and movable between a folded disposition in proximity to said lower surface thereof and an extended disposition at a predetermined angle with respect thereto;

(d) second leg means hingedly secured to said second top section and movable between a folded disposition in proximity to said lower surface thereof and an extended disposition at a predetermined angle with respect thereto;

(e) each of said first and said second leg means including a first surface and a second surface spaced one from the other and respectfully terminating along first and second edges;

(f) at least one opening formed to extend between said first surface and said second surface of each of said first and said second leg means and each such opening to extend from said first edges thereof to said second edges thereof, said openings being aligned in substantially the same horizontal plane when said first and said second leg means are disposed in said extended disposition thereof;

(g) a first work support means having a first portion of a size and configuration to be received within said opening of said first leg means and a second portion of a size and configuration to extend from said first portion outside said opening and in proximity to either said first edge or said second edge of said first leg means;

(h) a second work support means having a first portion of a size and configuration to be received within said opening of said second leg means and a second portion of a size and configuration to extend from said first portion outside of said opening and in proximity to either said first edge or said second edge of said second leg means;

(i) said first work support means and said second work support means cooperating to position an article to be worked on in an on-edge disposition along and in proximity to either one side or another side of the workbench.

2. The workbench of claim 1, wherein a plurality of said openings are formed in each of said first leg means and said second leg means so that respective ones of said openings align in different horizontal planes so that said first and second work support means when disposed in aligned openings can position an article to be worked on at selected heights with respect to said workbench top means.

3. The workbench of claim 2, wherein said first portions of each of said first work support means and said second work support means comprises a leg each of a size and configuration to be received in said opening and said second portion of each of said first work support means and said second work support means comprises an arm extending from and at substantially right angles to its respective leg.

4. The workbench of claim 1, including first side brace means connectable between said first top section and said first leg means to secure said first leg means in said extended disposition thereof, and second side brace means connectable between said second leg means and said second top section to secure said second leg means in said extended position thereof.

5. The workbench of Claim 4, including locking means to lock said first and second top sections when said top sections are disposed in said abutting arrangement.

6. The workbench of claim 5, wherein each said first brace means and said second brace means each include a turnbuckle selectively adjustable to adjust the respective side brace means and the cooperation thereof with the respective top section and leg means.

7. The workbench of claim 1, including end plate means disposed on either said first top section or said second top section proximate a respective end edge thereof and including a slot of a size, configuration and disposition to receive an edge of an article to be worked on when disposed in an on-edge disposition along side the workbench.

8. The workbench of claim 1, including end plate means disposed on both said first top section and said second top section proximate a respective end edge thereof and including a slot of a size, configuration and disposition to each receive an edge of an article to be worked on when disposed in an on-edge disposition along side the workbench.

9. The workbench of claim 1, including tray means of a size and configuration to hold tools or other devices or things to facilitate work and hingedly connected along a side edge of either said first top section or said second top section proximate an end edge thereof, said hinged connection permitting rotation of said tray means between a position along side the respective side edge and a position on top of said top surface thereof.

10. The workbench of claim 1, including an end support bar selectively connectable along either an end edge of either said first top section or said second top section or a side edge thereof proximate said end edge.

11. The workbench of claim 1, wherein when said top hinge means is in said second disposition thereof and said first leg means and said second leg means are each disposed in said folded disposition thereof the workbench is disposed in a relatively compact condition.

12. A workbench; comprising:

(a) workbench top means having an upper surface, a lower surface, a first end edge, a second end edge spaced from said first end edge and a pair of oppositely disposed side edges which are also spaced from each other;

(b) first leg means hingedly secured to top means and movable between a folded disposition in proximity to said lower surface thereof and an extended disposition at a predetermined angle with respect thereto;

(c) second leg means hingedly secured to said top means in spaced relationship with said first leg means and movable between a folded disposition in proximity to said lower surface thereof and an extended disposition at a predetermined angle with respect thereto;

(d) each of said first and said second leg means including a first surface and a second surface spaced one from the other and respectfully terminating along first and second edges;

(e) at least one opening formed to extend between said first surface and said second surface of each of said first and said second leg means and each such opening to extend from said first edges thereof to said second edges thereof, said openings being aligned in substantially the same horizontal plane when said first and said second leg means are disposed in said extended disposition thereof;

(f) a first work support means having a first portion of a size and configuration to be received within said opening of said first leg means and a second portion of a size and configuration to extend from said first portion outside said opening and in proximity to either said first edge or said second edge of said first leg means;

(g) a second work support means having a first portion of a size and configuration to be received within said opening of said second leg means and a second portion of a size and configuration to extend from said first portion outside of said opening and in proximity to either said first edge or said second edge of said second leg means;

(h) said first work support means and said second work support means cooperating to position an article to be worked on in an on-edge disposition along and in proximity to either one side or another side of the workbench.

13. The workbench of claim 12, wherein a plurality of said openings are formed in each of said first leg means and said second leg means so that respective ones of said openings align in different horizontal planes so that said first and second work support means when disposed in aligned openings can position an article to be worked on at selected heights with respect to said workbench top means.

14. The workbench of claim 13, wherein said first portions of each of said first work support means and said second work support means comprises a leg each of a size and configuration to be received in said opening and said second portion of each of said first work support means and said second work support means comprises an arm extending from and at substantially right angles to its respective leg.

15. The workbench of claim 12, including first side brace means connectable between said top means and said first leg means to secure said first leg means in said extended disposition thereof, and second side brace means connectable between said second leg means and said top means to secure said second leg means in said extended position thereof.

16. The workbench of claim 14, wherein each said first brace means and said second brace means each include a turnbuckle selectively adjustable to adjust the respective side brace means and the cooperation thereof with the respective top means and leg means.

17. The workbench of claim 12, including end plate means disposed on said top means proximate a respective end edge thereof and including a slot of a size, configuration and disposition to receive an edge of an article to be worked on when disposed in an on-edge disposition along side the workbench.

18. The workbench of claim 12, including tray means of a size and configuration to hold tools or other devices or things to facilitate work and hingedly connected along a side edge of said top means proximate an end edge thereof, said hinged connection permitting rotation of said tray means between a position along side the respective side edge and a position on top of said top surface thereof.

19. The workbench of claim 12, including an end support bar selectively connectable along either an end edge of said top means or a side edge thereof proximate said end edge.

20. A workbench; comprising:

(a) workbench top means including a first top section and a second top section each such top section including an upper surface, a lower surface, a center edge, an end edge spaced from said center edge and a pair of oppositely disposed side edges which are also spaced from each other;

(b) top hinge means connecting said first top section and said second top section along said respective center edges thereof such that in a first disposition of said top hinge means said first top section and said second top section are disposed with their respective center edges in abutting relationship and with their respective upper surfaces in a common plane; and so that in a second disposition of said top hinge means said lower surfaces of said respective first top section and said second top section are disposed in proximity one to the other;

(c) first leg means secured to said first top section so as to facilitate said depositions of said top hinge means; and (d) second leg means secured to said second top section so as to facilitate said respective dispositions of said top hinge means.

21. The workbench of claim 20; wherein:

(a) each of said first and second leg means includes first and second spaced edges; and (b) work support means disposed for cooperation with said first and second leg means to position an article to be worked on in an on-edge disposition and in proximity to respective ones of either said first edges or said second edges.

22. The workbench of claim 21; wherein:

(a) at least one opening is formed through each said first and second leg means, respectively, from said first edges thereof through said second edges thereof, said openings being aligned in substantially the same horizontal plane when said first and second leg means are disposed to support said workbench top sections in said common plane;

(b) a first work support means having a first portion received within said opening of said first leg means and a second portion which extends therefrom;

(c) a second work support means having a first portion received within said opening of said second leg means and a second portion which extends therefrom;

(d) said first work support means and said second support means cooperating to position an article to be worked on in an on-edge disposition along and in proximity to either one side or another side of the workbench.

23. The workbench of claim 22, wherein a plurality of said openings are formed in each of said first leg means and said second leg means so that respective ones of said openings align in different horizontal planes so that said first and second work support means when disposed in aligned openings can position an article to be worked on at selected heights with respect to said workbench top means.

24. The workbench of claim 23, wherein said first portions of each of said first work support means and said second work support means comprises a leg each of a size and configuration to be received in said opening and said second portion of each of said first work support means and said second work support means comprises an arm extending from and at substantially right angles to its respective leg.

25. The workbench of claim 20, including first hinge and side brace means connectable between said first top section and said first leg means to hingedly secure said first leg means to said first top section and second hinge and side brace means connectable between said second leg means and said second top section to hingedly secure said second leg means to said second top section.

26. The workbench of claim 25, including locking means to lock said first and second top sections when said top sections are disposed in said abutting arrangement.

27. The workbench of claim 26, wherein each said first brace means and said second brace means each include a turnbuckle selectively adjustable to adjust the respective side brace means and the cooperation thereof with the respective top section and leg means.

28. The workbench of claim 20, including end plate means disposed on either said first top section or said second top section proximate a respective end edge thereof and including a slot of a size, configuration and disposition to receive an edge of an article to be worked on when disposed in an on-edge disposition along side the workbench.

29. The workbench of claim 20, including end plate means disposed on both said first top section and said second top section proximate a respective end edge thereof and including a slot of a size, configuration and disposition to each receive an edge of an article to be worked on when disposed in an on-edge disposition along side the workbench.

30. The workbench of claim 20, including tray means of a size and configuration to hold tools or other devices or things to facilitate work and hingedly connected along a side edge of either said first top section or said second top section proximate an end edge thereof, said hinged connecting permitting rotation of said tray means between a position along side the respective side edge and a position on top of said top surface thereof.

31. The workbench of claim 20, including an end support bar selectively connectable along either an end edge of either said first top section or said second top section or a side edge thereof proximate said end edge.

32. The workbench of claim 20, wherein said top hinge means is in said second disposition thereof and said first leg means and said second leg means are each disposed in folded disposition the workbench is disposed in a relatively compact condition.

33. A workbench; comprising:

(a) workbench top means;

(b) first leg means secured so said workbench top means to support said workbench top means in at least a first predetermined disposition;

(c) second leg means secured to said workbench top means in spaced relationship with said first leg means to support said workbench top means in said at least said first predetermined disposition;

(d) each of said first and said second leg means including a first surface and a second surface spaced one from the other and respectfully terminating along first and second edges;

(e) at least one opening formed to extend between said first surface and said second surface of each of said first and said second leg means and each such opening to extend from said first edges thereof to said second edges thereof, said openings being aligned in substantially the same horizontal plane when said first and second leg means are disposed in said extended disposition thereof;

(f) a first work support means having at least a first portion of a size and configuration to be received within said opening of said first leg means and at least a second portion of a size and configuration to extend outside said opening;

(g) a second work support means having at least a first portion of a size and configuration to be received within said opening of said second leg means and at least a second portion of a size and configuration to extend outside of said opening;

(h) said first support means and said second work support means cooperating to position an article to be worked on in an on-edge disposition along and in proximity to either one side or another of the work bench.

34. The workbench of claim 33, wherein a plurality of said openings are formed in each of said first leg means and said second leg means so that respective ones of said openings align in different horizontal planes so that said first and second work support means when disposed in aligned openings can position an article to be worked on at selected heights with respect to said workbench top means.

35. The workbench of claim 34, wherein said first portions of each of said first work support means and said second work support means comprises a leg each of a size and configuration to be received in said opening ad said second portion of each of said first work support means and said second work support means comprises an arm extending from and at substantially right angles to its respective leg.

36. The workbench of claim 33, including first side brace means connectable between said top means and said first leg means to secure said first leg means in position and second side brace means connectable between said second leg means and said top means to secure said second leg means in position.

37. The workbench of claim 36, wherein each said first brace means and said second brace means each include a turnbuckle selectively adjustable to adjust the respective side brace means and the cooperation thereof with the respective top means and leg means.

38. The workbench of claim 33, including end plate means disposed on said top means proximate a respective edge thereof and including a slot of a size, configuration and disposition to receive an edge of an article to be worked on when disposed in an on-edge disposition along side the workbench.

39. The workbench of claim 33, including tray means of a size configuration to hold tools or other devices or things to facilitate work and hingedly connected along a side edge of said top means proximate an end edge thereof, said hinged connection permitting rotation of said tray means between a position along side the respective side edge and a position on top of said top surface thereof.

40. The workbench of claim 33, including an end support bar selectively connectable along either an end edge of said top means or a side edge thereof proximate said end edge.

* * * * *